United States Patent [19]

Hoffman

[11] Patent Number: 4,516,067

[45] Date of Patent: May 7, 1985

[54] REGULATED POWER SUPPLY WITH CURRENT REGULATING CIRCUIT

[75] Inventor: Philip A. Hoffman, Towson, Md.

[73] Assignee: Solid State Chargers Research and Development Limited Partnership, Lutherville, Md.

[21] Appl. No.: 584,607

[22] Filed: Feb. 29, 1984

Related U.S. Application Data

[63] Continuation-in-part of Ser. No. 524,356, Aug. 18, 1983, , which is a continuation-in-part of Ser. No. 472,758, Mar. 7, 1983, Pat. No. 4,504,774.

[51] Int. Cl.[3] ..... G05F 1/44

[52] U.S. Cl. ..... 323/265; 323/273; 323/278; 323/282

[58] Field of Search ..... 320/2, 9, 35, 39, 53, 320/57, 59, DIG. 1; 323/223, 265, 273, 278, 282, 284, 285, 303, 311; 363/89

[56] References Cited

U.S. PATENT DOCUMENTS 4,001,668 1/1977 Lewis ..... 363/89
4,101,808 7/1978 Flint ..... 323/282

OTHER PUBLICATIONS

Rehak, Peter A., "Micropower Voltage Regulator with Very Low Vout-Vin", *Electronic Engineer.*

*Primary Examiner*—Peter S. Wong

*Assistant Examiner*—Anita M. Ault

*Attorney, Agent, or Firm*—Leonard Bloom

[57] ABSTRACT

A power supply which includes terminals for connection to an electric power source, a storage capacitance, an electrical charging circuit and an operative arrangement for connecting the storage capacitance in series with the charging circuit across the terminals. The power supply has a charging circuit which includes a first resistor, a second resistor, a third resistor and a rectifier, constituted by at least one diode, in series. A control stage includes a first transistor, which has a collector-emitter path and a base-emitter path. The transistor is operatively connected so that the base-emitter path is connected in parallel with the first resistor. A fourth resistor is provided, the fourth resistor being connected in series with the collector-emitter path of the transistor and the third resistor. In one embodiment, the charging current carrying stage includes a plurality of additional transistors, connected in Darlington configuration, which are controlled by the first transistor which is operatively arranged to be controlled by a signal which corresponds to the D.C. voltage output and is produced by a D.C. voltage sensing circuit and responds to the unfiltered output from the rectifier. An optical coupler is connected between the D.C. output voltage sensing circuit, which may be a Schmidt trigger, and the control stage. A field-effect transistor, preferably a MOSFET, can replace the plurality of transistors in the Darlington configuration.

26 Claims, 11 Drawing Figures

REGULATED POWER SUPPLY WITH CURRENT REGULATING CIRCUIT

CROSS REFERENCE TO RELATED APPLICATIONS

This application is a continuation-in-part of patent application Ser. No. 524,356 filed Aug. 18, 1983 and entitled "Power Supply With Current Regulating Circuit" which is a continuation-in-part of patent application Ser. No. 472,758 filed on Mar. 7, 1983 now U.S. Pat. No. 4,504,774 and entitled "Current Regulating Circuit". The disclosures in the two related applications are incorporated herein in their entirety by reference.

FIELD OF THE INVENTION

The present invention relates to a power supply which includes a current regulating circuit especially adaptable for integrated circuit manufacture, and more particularly, to a power supply having a rectifying means and a current regulating circuit which may be fabricated as a relatively-small solid state component and operatively associated with a smoothing circuit, which may comprise a storage capacitor, as well as other output circuitry. Circuitry responsive to the D.C. output voltage level may be provided to produce a control signal which is used to control the current regulating circuit.

BACKGROUND OF THE INVENTION

While not restricted thereto, this invention finds immediate application in simple, inexpensive power supply circuits which are especially useful for powering small loads such as logic circuits, microprocessor chips and other small D.C. powered devices.

It is known from U.S. Pat. No. 3,943,423 to Philip A. Hoffman entitled "Battery Charging Circuit" and issued on Mar. 9, 1976 to provide a battery charging circuit which eliminates the need for a relatively bulky and heavy voltage step-down transformer, and which, when recharging batteries in a hand tool or the like, needs simply to be connected to a conventional, 117 volt 60 Hz household outlet and to the battery cell or cells which are to be recharged. Other outlet voltage levels and/or supply frequencies can be used as well. The known charging circuit of the aforesaid Hoffman patent comprises a variable resistance switch preferably realized in the form of a PNP junction transistor and Darlington-connected other transistors operatively associated with a feedback circuit. This known circuit has, in addition to the transistors and resistors, two rectifying diodes and two capacitors, resulting in a circuit which, particularly because of the need for the capacitors and a considerable number of passive components, becomes relatively more expensive to realize as an integrated circuit than the current regulating circuit used as part of the present invention and would be somewhat bulky and more expensive to miniaturize.

It is known from the further U.S. Pat. No. 3,970,912 issued on July 20, 1976 to Philip A. Hoffman and entitled "Battery Charging Circuit" to provide a battery charging circuit free of transformers and operatively arranged to produce current pulses which are supplied to the battery or batteries to be recharged via the inductance of an electric motor, which forms part of a cordless hand tool or the like. This circuit, while not requiring capacitors, does require at least two diodes and an inductance, albeit the inductance of an electric motor which is a portion of a powered hand tool or the like. As a result, this circuit has somewhat limited utility because of the requirement for an inductance, and, in particular, the inductance provided by a D.C. electric motor.

A considerable number of battery chargers have been proposed and are known from the general prior are including U.S. Pat. Nos. identified as follows:

| U.S. Pat. Nos. | Patentees | Issue Date |
|---|---|---|
| 3,281,639 | Norman M. Potter | October 25, 1966 |
| 3,735,233 | Richard B. Ringle | May 22, 1973 |
| 3,876,921 | John H. Bigbee, III | April 8, 1975 |
| 4,013,934 | George J. Frye | March 22, 1977 |
| 4,140,958 | Charles R. Groeschel | February 20, 1979 |
| 4,158,813 | Robert W. Ellis et al. | June 19, 1979 |
| 4,162,439 | Arthur Schneider | July 24, 1979 |
| 4,186,335 | Harold J. Cahill | January 29, 1980 |
| 4,220,905 | William T. Quarton | September 2, 1980 |
| 4,266,178 | Tatsushi Asakawa | May 5, 1981 |
| 4,292,578 | Robert L. Steigerwald et al. | September 29, 1981 |
| 4,321,523 | Ronald O. Hammel | March 23, 1982 |
| 4,348,619 | Ray et al. | September 7, 1982. |

It is also known from Mims III "Engineer's Notebook A Handbook of Integrated Circuit Applications", First Edition, Second Printing, pg. 95, Radio Shack, A division of the Tandy Corporation, U.S.A. (1979) to use integrated circuits in battery chargers.

It is known from U.S. Pat. No. 3,049,623 to Wilber E. DuVall entitled "Auxiliary Power Supply" and issued on Aug. 14, 1962 to provide a power supply which includes a rectifier and storage capacitance, the latter being coupled to output terminals via transistor circuitry.

Voltage regulator circuits which use Zener diodes are widely known, examples can be seen in U.S. Pat. Nos. identified as follows:

| U.S. Pat. Nos. | Patentees | Issue Date |
|---|---|---|
| 3,217,229 | Lyttleton W. Ballard | November 9, 1965 |
| 3,530,367 | Robert A. Gardenghi | March 7, 1969. |

SUMMARY OF THE INVENTION

An object of the present invention is to provide an improved power supply which includes a current regulating circuit for supplying current pulses to a smoothing circuit, which may comprise a storage capacitance.

Another object of the present invention is to provide a power supply circuit which is simple, inexpensive and can readily be realized, so far as its rectifying and current regulating components are concerned, as an integrated circuit.

An additional object of the present invention is to provide a power supply which is simple, inexpensive, small and lightweight.

A further object of the present invention is to provide a simple, inexpensive power supply which can be operated from a conventional 117 volt, 60 Hz, or 234 volt A.C., 60 Hz, power source and which can be operated as well from power sources having different voltages and frequencies.

Yet another object of the present invention is to provide a power supply which supplies current pulses to a smoothing circuit and has D.C. output voltage regulation.

The foregoing objects, as well as others which are to become apparent from the text below, can be achieved in accordance with the present invention by providing in a power supply having rectifying circuit means for supplying unfiltered rectified voltage, circuit means for producing current pulses and smoothing circuit means for providing D.C. voltage output connected in series. Voltage output sensing means, which is coupled to the smoothing circuit, is responsive to the D.C. voltage output and produces a control signal whenever the D.C. voltage output reaches or exceeds at least a given level. The circuit means for producing current pulses is responsive to the control signal and to instant amplitude of the unfiltered rectified voltage and passes current to the smoothing circuit means in absence of the control signal during periods when the rectified voltage is between a first level defined by voltage across the smoothing circuit means and a higher second level and to block current to the smoothing circuit means during periods when the rectified voltage is greater than the second level.

The invention can be viewed as a power supply comprising rectifying circuit means for supplying rectified voltage, circuit means for producing current pulses and smoothing circuit means for providing D.C. voltage output connected in series, and D.C. voltage output sensing means coupled to the smoothing circuit and responsive to the D.C. voltage output for producing a control signal whenever the D.C. voltage output reaches or exceeds at least a given level. The circuit means for producing current pulses is responsive to the control signal to block current pulses to the smoothing circuit whenever the control signal is present and to pass current pulses to the smoothing circuit means in absence of the control signal during predetermined periods.

The D.C. voltage output sensing means initially produces the control signal whenever the D.C. voltage reaches or exceeds at least the given level and continues to produce the control signal so long as the D.C. voltage output does not reach a second given level which is less than the first given level.

Optical coupling means are provided between the D.C. output voltage sensing means, preferably a Schmitt trigger, and circuit means for producing current pulses.

The circuit for producing current pulses may include a control stage and controlled charging current carrying means coupled to the smoothing circuit means for supplying current thereto, the control stage being responsive to a control signal corresponding to control signal produced by the D.C. output voltage sensing means.

The control stage may include a first transistor and the controlled charging current carrying means may include at least one Darlington configured plurality of transistors, having control signal input means coupled to the control stage and responsive to its output.

The control stage may include a first transistor and the controlled charging current carrying means may include at least one field effect transistor having a control signal input means coupled to the control stage and responsive to its output.

DETAILED DESCRIPTION OF THE PREFERRED EMBODIMENT

Figure 1A:
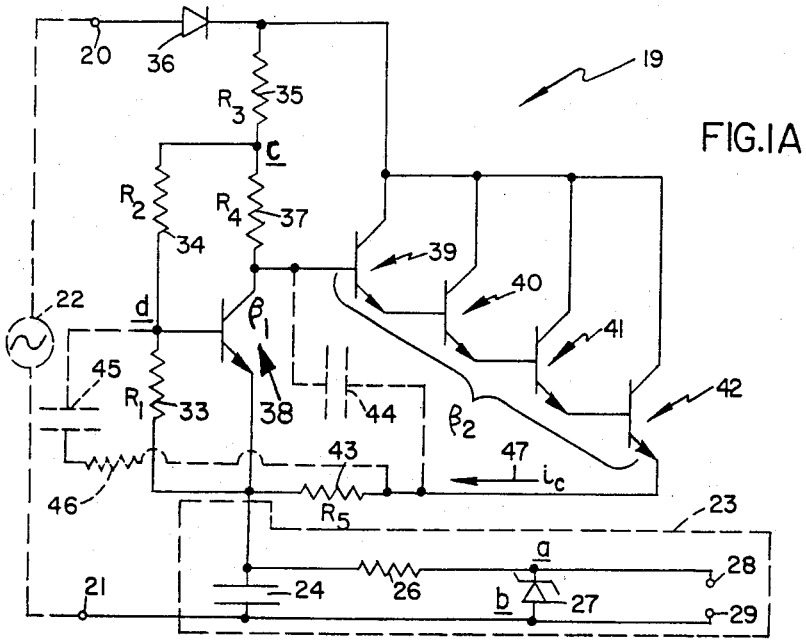
FIGS. 1A and 1B are respectively a circuit diagram of a first embodiment of a power supply and a variant thereof.
Figure 1B:
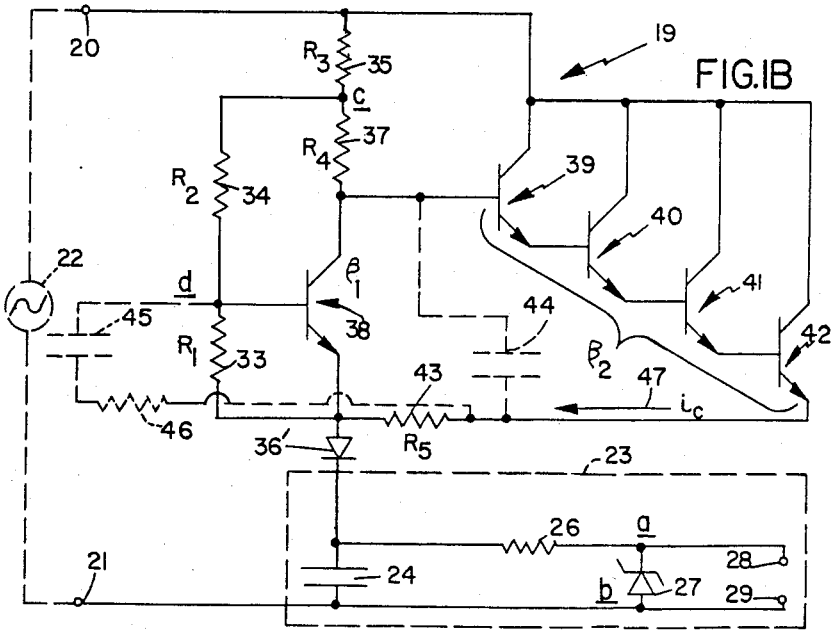

As illustrated in FIGS. 1A and 1B, the illustrative, first embodiment, as well as a variant thereof, of a power supply includes a current regulating circuit generally designated by the numeral 19 and includes a pair of terminals 20, 21 which are shown, for purposes of illustration, connected across a conventional, 117 volt 60 Hz voltage source 22. Also shown in FIGS. 1A and 1B is a smoothing circuit 23 which includes a 1000 $\mu$f storage capacitor 24 realized as an electrolytic capacitor having an electrode connected to the terminal 21. A 56 ohm resistor 26 and a Zener diode 27 are connected in series across the storage capacitor 24, output terminals 28, 29 of the power supply being connected across the Zener diode 27, that is, between circuit points a and b. The Zener diode 27 can be realized, for example, as a 9.1 volt diode designated by the numeral ECG 5018A. The current regulating circuit designated generally by the numeral 19 is connected between the smoothing circuit 23 and the terminal 20, placing the storage capacitor 24 in circuit so that it can receive current pulses from the current regulating circuit 19. The current regulating circuit 19 operates to charge the capacitor 24.

It is to be appreciated that the circuit illustrated in FIGS. 1A and 1B can be utilized to charge capacitors of considerably different sizes and voltage levels from sources of different levels and/or supply frequencies, the conventional 117 volt and 234 volt levels and 60 Hz frequency being set out by way of example only. The current regulating circuit 19 includes, a first resistor 33 (resistance $R_1$), a second resistor 34 (resistance $R_2$ between circuit points c and d), a third resistor 35 (resistance $R_3$) and a rectifying diode 36 (FIG. 1A) or the rectifying diode 36' (FIG. 1B) connected between that plate of the capacitor 24 which is not connected to the terminal 21 and the terminal 20 of the charging circuit. As illustrated, the rectifying diode 36 (FIG. 1A) has its anode connected to the terminal 20 and its cathode connected to one end of the resistor 35. As shown in FIG. 1B, the rectifying diode 36′ has its cathode connected to one of the plates of the capacitor 24, its anode being connected to the free end of the resistor 33. A fourth resistor 37 (resistance $R_4$) is connected between the connection point of the second resistor 34 and the third resistor 35 and the collector of an NPN transistor 38, which has its emitter connected to one end of the first resistor 33. The other end of the first resistor 33 is connected to the base of the transistor 38, as well as to one end of the second resistor 34. The transistor 38 and resistors 33, 34, 35 and 37 constitute the control stage of the current regulating circuit 19. The collector of the transistor 38 is connected, in turn, to a current amplifier which includes a Darlington connected series of NPN junction transistors 39–42. The Darlington connected transistors are selected so as to provide a relatively high current gain, for example, a current gain ($\beta_2$) of approximately 200,000, while the control stage which includes the transistor 38 is selected to also have a current gain ($\beta_1$), for example, of about 100. The collectors of each of the transistors 39–42 are connected to the cathode of the rectifying diode 36 (FIG. 1A) or to the terminal 20 of the power supply 22 (FIG. 1B). The base of the first of the transistors 39–42, that is the transistor 39 is connected to the collector of the switching transistor 38. The emitter of the final one of the Darlington-connected transistors 39–42, that is the transistor 42, is connected to one plate of the capacitor 24 and to the emitter of the transistor 38, via a current-limiting fifth resistor 43 ($R_5$). The current-limiting fifth resistor 43 is a positive temperature coefficient (PTC) resistance, formed by metallization from materials which are selected so that this resistor will also function as a fuse, allowing circuit failure without damage to the capacitor 24 or other smoothing circuit components or the load which may be connected across the terminals 28, 29 or endangering the surroundings. The current regulating circuit 19 illustrated in FIGS. 1A and 1B, is not provided with external feedback between the output of the current amplifier constituted by the Darlington circuit configured transistors 39–42 and the switching transistor 38; however, internal feedback is provided by the third resistance 35 because of its coupling to the base of the transistor 38 via the second resistance 34 and the first resistance 33 connected as illustrated.

In order to avoid the possibility of the circuits 19 oscillating, a small capacitance 44 may be connected between the collector of the transistor 38 and the emitter of transistor 42 and/or a series connection of a small capacitor 45 and a resistor 46 is connected between the base of the transistor 38 and the emitter of the transistor 42.

By way of example only, typical values for circuit parameters of the battery charging circuit illustrated in FIGS. 1A and 1B, which would be used in an exemplary integrated circuit embodiment are:

| | |
|---|---|
| $R_1$ = 8,946 ohms, | $i_a$ = .12 ampere (average), |
| $R_2$ = 120,543 ohms, | $i_p$ = 5.0 ampere (peak), |
| $R_3$ = 54,668 ohms, | $\beta_1$ = 100 (current gain, control stage), |
| $R_4$ = 13,667 ohms, | $\beta_2$ = 200,000 (current gain, |
| $R_5$ = .385 ohms, | current amplifier). |

It is to be appreciated that the individual values for the resistances $R_1$–$R_4$ can vary considerably, as a practical matter by about ±20 percent, the exact values for resistances $R_1$–$R_4$ not being nearly as important as the ratios among them. The ratios of $R_1$:$R_4$, $R_2$:$R_4$ and $R_3$:$R_4$, in a practical case, should desirably be within the range of substantially ±5 percent and preferably substantially ±1 percent. These criteria make it possible to realize the charging circuits 19 of FIGS. 1A and 1B as integrated circuits using diffusion techniques. It is conceived that the integrated circuit, in an exemplary practical realization, can be contained within a small housing preferably of cylindrical shape and having a length of about 3/16 inch and a diameter of about 5/36 inch. Two concentric wire leads, each of about one inch, can be provided to extend from the housing. The smoothing circuit 23, except for the storage capacitor 24, may be part of an integrated circuit, and preferably is part thereof.

Accordingly, expressing the above-mentioned ratios as constants $K_1$, $K_2$ and $K_3$, respectively, we have: $K_1=0.65\pm0.03=R_1/R_4$, $K_2=8.82\pm0.44=R_2/R_4$, and $K_3=4.00\pm0.20=R_3/R_4$; or, as the preferred case is, $K_1=0.65\pm0.006$, $K_2=8.82\pm0.088$ and $K_3=4.00\pm0.04$.

The fifth resistance $R_5$ need not be in a particular ratio with respect to the other resistances and can readily be formed by metallization and be constituted by a metal contact to or between circuit points. The resistance $R_5$ is desirably a positive temperature coefficient (PTC) resistance, which increases in value as temperature increases, thus limiting current flow. The size of resistance $R_5$, relative to the sizes of resistance $R_1$–$R_4$, is very small. The resistance $R_5$ acts to stabilize the current regulating circuit which, in a practical case, operates at a temperature of about 125° C. during charging when the chip is provided with a suitable thermal mounting. Charging current will decrease with an increase in ambient temperature of approximately forty-five hundredths of one percent (0.45%) per degree Centigrade.

Figure 5A:
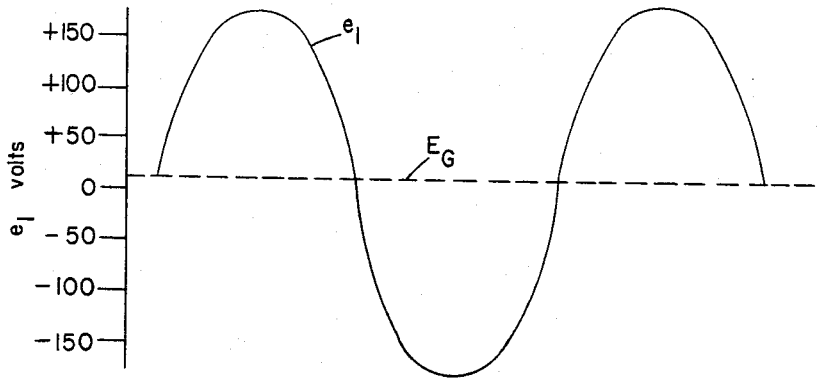
FIGS. 5A–5C are voltage and current waveforms at various locations in the circuits illustrated in FIGS. 1A, 1B, 2, 3 and 4, helpful in understanding the operation thereof.
Figure 5B:
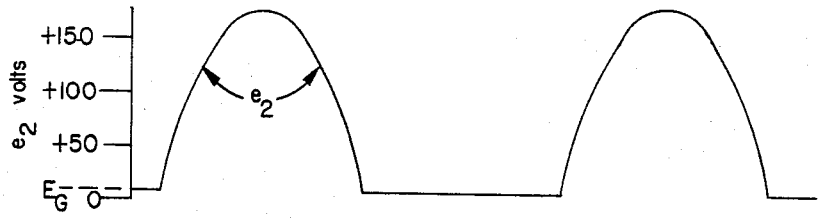
Figure 5C:
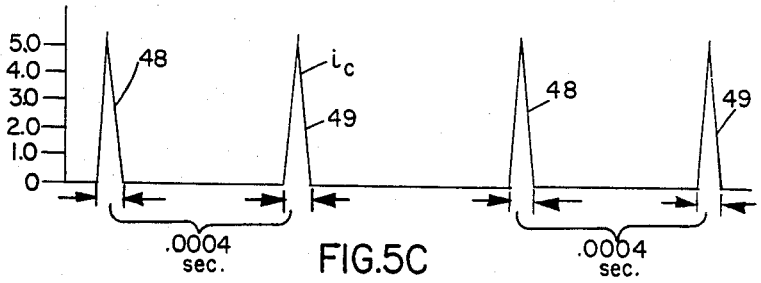

In operation, the circuit arrangements shown in FIGS. 1A and 1B are placed in operation by connecting the current regulating circuit 19 to the voltage source 22 which is shown as connected between the input terminals 20,21 of the current regulating circuit 19. The capacitor 24 to be charged is connected between the terminal 21 and the current regulating circuit 31 (its voltage being illustrated in FIGS. 5A and 5B as $E_b$). FIG. 5A shows the voltage waveform $e_1$ as a function of time of the input source voltage 22 for a conventional 117 volt (rms), 60 Hz household outlet supply. FIG. 5B is a waveform $e_2$ of the rectified voltage at the output of the rectifier diode 36 (FIG. 1A) or 36′ (FIG. 1B). The voltage waveforms as shown in FIGS. 5A and 5B are illustrated for one and one-half cycles of the 60 Hz input. FIG. 5C is a corresponding waveform of the charging current $i_c$, during operation after the stable operating temperature of about 125° C. has been reached, as indicated by the arrow 47 shown in FIGS. 1A and 1B through the fifth resistor 43 and into the capacitor 24. As can be seen in FIG. 5C, there are two current spikes 48, 49 for each cycle of A.C. input, the peak charging current $i_p$ being about 5.0 amperes. These current spikes 48, 49, as can be seen, are relatively short in duration, for example about 0.0004 seconds, resulting in an average charging current $i_a$ of about 0.12 ampere.

Referring again to FIGS. 1A, 1B, the diode 36 (FIG. 1A) or the diode 36′ (FIG. 1B) provides a source of input current for the Darlington configured current amplifier defined by the transistors 39–42, as well as operating voltage for the switching transistor 38 of the control stage. Initially, relatively high current spikes are produced, causing the PTC resistor 43 to increase in value, because of heating thereof; resulting in the current spikes having lesser magnitudes as they approach the 5.0 ampere level and the chip achieves its stable operating temperature of about 125° C. Thereafter, when the A.C. voltage $e_1$ of the source 22 is positive and slightly greater, for example less than 2.6 volts with respect to the voltage $E_b$ of the capacitor 24 which is to be charged, the transistors 38 and 39–42 do not conduct. When the voltage difference reaches about 2.6 volts, capacitor charging current starts to flow through the transistors 39–42, illustrated as the leading edge of the current spike 48 in FIG. 5C. The current into the base of the transistor 39 in effect is amplified by the transistors 39–42 and initially flows at a relatively low level, through the fifth resistor 43 into the capacitor 24 thereby starting to charge the capacitor 24 as the leading edge of the current spike 48 starts toward the 5.0 ampere level. This current, illustrated as current spike 48, can be considered to be increasing as the voltage supplied to the collectors via the rectifying diode 36 (FIG. 1A) or the rectifying diode 36' (FIG. 1B) becomes more positive and reaches its peak of about 5.0 amperes when the line voltage $e_1$ is about 10 volts greater than the capacitor voltage $E_b$. Increasing current is supplied not only to the Darlington connected transistors 39–42, but also to the base of the transistor 38, via the voltage divider consisting of the first resistor 33, the second resistor 34 and the third resistor 35, which are connected in series, as pointed out above, between the diode 36 (FIG. 1A) and one plate of the capacitor 24 or between the diode 36' (FIG. 1B) and the terminal 20 of the source 22. Once the current into the base of the transistor 38 is sufficient, when the line voltage $e_1$ reaches the level of about 10.0 volts greater than the voltage $E_b$ of the capacitor 24, to turn this transistor on, considerable current starts to flow through the emitter-collector path thereof, reducing the voltage, and thus the current, supplied to the base of the transistor 39 causing the current amplifier, consisting of the transistors 39–42 connected in Darlington configuration, to exhibit reduced current flow, as illustrated by the trailing edge of the current spike 48 in FIG. 5C and quickly turn off the resulting current spike 48 which has a duration of about 0.0004 second. The transistors 39–42 are turned off when the line voltage $e_1$ reaches a difference of about 27.6 volts with respect to storage capacitor voltage $E_b$. During this time period, because of the internal feedback provided as a result of the lowering of the voltage, at the point of connection between the second resistor 34 and the third resistor 35, the effective resistance of the transistor 38 increases. The transistors 39–42 are again turned on when the difference between the line voltage again reaches, as it falls, about 27.6 volts with respect to the storage capacitor voltage $E_b$ while the transistor 38 is conducting, with the result of the leading edge of the current spike 49 of FIG. 5C is produced, this current spike reaching a peak of about 5.0 amperes when the voltage difference between the voltage $e_1$ and the storage capacitor voltage $E_b$ again reaches about 10 volts. The transistors 39–42 remain conducting until the difference between the input voltage $e_1$ and the storage capacitor voltage $E_b$ again reaches about 2.6 volts. Thus current spike 49 of about 5.0 amperes and 0.0004 second duration is produced. These actions take place every other half cycle of the input voltage $e_1$ with the result that the two current spikes 48, 49 are produced, one at the starting portion and the other at the ending portion of each of these half cyles. Thus, a charging current spike is produced for a short period of time, for example, of about 0.0004 seconds as indicated above during an initial portion of the rectified half-wave voltage output $e_2$ from the rectifying diode 36 (FIG. 1B) or the diode 36' (FIG. 1B) and another current spike during its terminal portion, both spikes have a duration of about 0.0004 seconds as indicated above. These actions take place time and time again providing, in effect, a charge in the form of current spikes to the capacitor 24 which continue until the capacitor 24 is fully charged. During this time, the capacitor may be discharging, via the output terminals 28, 29, into a load, the Zener diode 27 providing a regulated output voltage, that is, this diode 27 conducts whenever a given predetermined D.C. output voltage appears between the circuit points a and b.

It is to be appreciated that were a 234 Volt, 60 Hz source used instead of the 117 Volt 60 Hz source (and if the effects of temperature changes within the circuit are ignored), the peak amplitude of current spikes 48, 49 (FIG. 5C) would not change but the time duration of these current spikes and the average current would be halved. However, in practice, the operating temperature of the circuit at the higher source voltage would be less than when the source is 117 Volts, thereby decreasing the value of the PTC resistor 43 and increasing the peak amplitude of the current spikes 48, 49. In addition, the lower circuit temperature would increase the gate-emitter threshold voltage of transistor 38 (FIGS. 1A, 1B) thereby tending to increase both the duration of the current spikes and the peak amplitudes of the current spikes. As a result of the lowered circuit temperature when the device is operated at higher source voltages, the reduction in average current is considerably less than would be the case if the circuit temperature were to remain constant.

Figure 2:
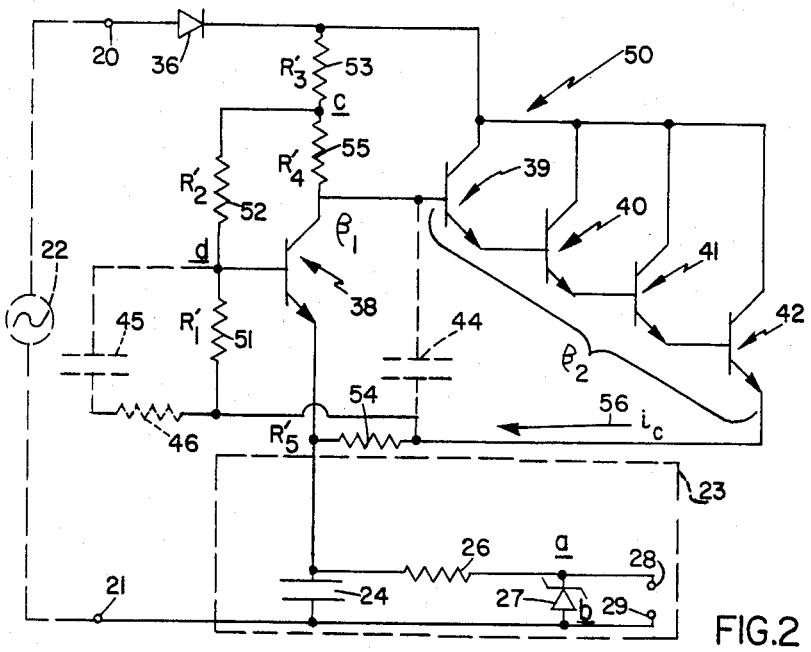
FIG. 2 is a circuit diagram of a second embodiment of a power supply.

As illustrated in FIG. 2, like reference numerals designating like circuit components to those shown in FIGS. 1A and 1B, the illustrative, second embodiment of a power supply circuit constructed in accordance with the present invention is generally designated by the numeral 50 and includes a pair of terminals 20, 21 which are shown, for purposes of illustration, connected across a conventional, 117 volt, 60 Hz voltage source 22. Also shown in FIG. 2 is a smoothing circuit 23 which includes a 1000 $\mu$f storage capacitor 24, which may be an electrolyte capacitor. The capacitor 24 is connected between the terminal 21 and the emitter of the transistor 38. A 56 ohm resistor 26 and a Zener diode 27 are connected in series across the storage capacitor 24, output terminals 28, 29 of the power supply being connected across the Zener diode 27 between circuit points a and b. The Zener diode 27 can be realized, for example, as a 9.1 volt diode designated by the numeral ECG 5018A. The current regulating circuit designated generally by the numeral 50 is connected in series with the capacitor 24 across the terminals 20, 21.

The basic circuit 50, as illustrated in FIG. 2, can be used to charge capacitors from 117 volt, 60 Hz power supplies and from 234 volt, 60 Hz power supplies. It is to be appreciated, however, that the charging circuit illustrated in FIG. 3 can be utilized to charge capacitors in a power supply of considerably different voltage levels and itself have different levels and/or supply frequency, the above-mentioned levels and frequency being set out by way of example only. The current regulating circuit 50 includes a first resistor 51 (resistance $R'_1$) and a second resistor 52 (resistance $R'_2$ between circuit points c and d), a third resistor 53 (resistance $R'_3$) may be included if internal feedback is desired, in series with a rectifying diode 36 and connected between the terminals 21, 20, via a current-limiting further resistor 54 (resistance $R'_5$). As illustrated, the rectifying diode 36 has its anode connected to the terminal 20 and its cathode connected to one end of the third resistor 53. As in the case illustrated in FIG. 1B, a variant of the circuit of FIG. 2 is possible by replacing the diode 36, with a rectifying diode connected between one plate of the capacitor 24 and the circuit connection between the resistor 54 with the emitter connection of the transistor 38. A fourth resistor 55 (resistance $R'_4$) is connected between the connection of the second resistor 52 and the third resistor 53 and the collector of the NPN transistor 38, which has its emitter connected to the smoothing circuit 23 and, via the fifth resistor 54, to one end of the first resistor 51, which has its other end connected to the base of the transistor 38, as well as to one end of the second resistor 52. The transistor 38 and the resistors 51–55 constitute the control stage of the current regulating circuit 50. In the event the third resistor 53 is not present, the resistance $R'_3$ being zero, and the ends of the resistor 52 and the resistor 55 not connected to electrodes of the transistor 38 would be connected directly to the cathode of the diode 36. In this case, only external feedback would be provided. The collector of the transistor 38 is connected, in turn, to a Darlington configured series of NPN junction transistors 39–42. The Darlington configured transistors 39–42 are selected so as to provide a relatively high current gain, for example, a current gain ($\beta_2$) of approximately 200,000, while the transistor 38 of the control stage is selected to also have in circuit a relatively high current gain ($\beta_1$), for example, a gain of about 100. The collectors of each of the transistors 39–42 are connected to the cathode of the rectifying diode 36. The base of the first of the transistors 39–42, that is the transistor 39, is connected to the collector of the transistor 38. The emitter of the final one of the Darlington-connected, current amplifying transistors 39–42, that is the transistor 42, is connected to the emitter of the control transistor 38, via the fifth resistor 54. The current regulating circuit 50 illustrated in FIG. 2, is provided with external feedback between the output of the amplifier constituted by the Darlington circuit configured transistors 39–42 and the switching transistor 38 via the fifth resistor 54 which has its end not connected to the capacitor 24 connected to that end of the first resistor 51 which is not connected to the base of the transistor 38. Additional internal feedback is provided, as in the embodiment illustrated in FIG. 2, by virtue of the third resistor 53 (resistor 35, FIGS. 1A and 1B) because of its coupling to the base of the transistor 38, as illustrated.

Again, by way of example only, typical values for circuit parameters of the charging circuit illustrated in FIG. 2, which could be used in an integrated circuit embodiment are:

| | |
|---|---|
| $R'_1$ = 7,640 ohms, | $i_a$ = .12 ampere (average), |
| $R'_2$ = 102,740 ohms, | $i_p$ = 5.0 ampere (peak), |
| $R'_3$ = 53,440 ohms, | $\beta_1$ = 100 (current gain, control stage), |
| $R'_4$ = 13,360 ohms, | $\beta_2$ = 200,000 (current gain, |
| $R'_5$ = .110 ohms, | current amplifier). |

As in the embodiment illustrated in FIGS. 1A, 1B, the individual values for the resistances $R'_1$–$R'_4$ can vary considerably, as a practical matter by about ±20 percent, the exact values for resistances $R'_1$–$R'_4$ not being as important as the ratios among them. The ratios of $R'_1$:$R'_4$, $R'_2$:$R'_4$ and $R'_3$:$R_4$, in a practical case should desireably be within the range of substantially ±5 percent and preferably substantially ±1 percent. These criteria make it possible to realize the current regulating circuit 50 of FIG. 2 as an integrated circuit using diffusion techniques, the same dimensional characteristics mentioned in conjunction with the embodiment illustrated in FIGS. 1A and 1B applying equally well to this embodiment. Accordingly, expressing the above-mentioned ratios as constants $K'_1$, $K'_2$ and $K'_3$, respectively, we have $K'_1 = 0.57 \pm 0.03 = R'_1/R'_4$,
$K'_2 = 7.69 \pm 0.38 = R'_2/R'_4$, and
$K'_3 = 4.00 \pm 0.20 = R'_3/R'_4$; or, as the prefered case is:
$K'_1 = 0.57 \pm 0.066$, $K'_2 = 7.69 \pm 0.076$, and
$K'_3 = 4.00 \pm 0.04$.

The resistance $R_5$ need not be in a particular ratio with respect to the other resistances and can easily be formed by metallization and be constituted by a metal contact to or between circuit points. As in the cases of FIGS. 1A and 1B, the resistance $R_5$ is desirably, a positive temperature coefficient (PTC) resistance, which increases in value as the temperature increases, thus limiting the current flow and serving to stabilize the circuit which in a practical integrated circuit version may operate at a chip temperature of about 125° C. during capacitor charging when the chip is provided with a suitable thermal mounting. The PTC resistor 54 ($R'_5$) is preferably formed by metallization with materials which are selected so that the resistor will also function as a fuse, allowing the circuit to fail without damaging the capacitor 24 undergoing charging, the other components of the smoothing circuit 23 and the device or devices connected to the terminals 28, 29, and endangering the surroundings. Charging current will decrease with an increase in ambient temperature of approximately ¼ percent per degree Fahrenheit.

In order to avoid the possibility of the circuit 50 oscillating, a small capacitance 44 may be connected between the collector of the transistor 38 and the emitter of the transistor 42 and/or a series connection of a small capacitor 45 and a resistor 46 may be connected between the base of the transistor 38 and the emitter of the transistor 42.

In operation, the circuit arrangement shown in FIG. 2 is placed in operation by connecting the current regulating circuit 50 in series with the capacitor 24 to the voltage source 22 which is shown as connected between the input terminals 20,21 of the circuit. The capacitor 24 to be charged is connected between the terminal 21 and the emitter of the transistor 38. FIG. 5A shows the voltage waveform $e_1$ as a function of time of the input source voltage 22 for a conventional 117 volt rms, 60 Hz household outlet supply. FIG. 5B is a waveform $e_2$ of rectified voltage at the output of the diode 36. The voltage waveforms as shown in FIGS. 5A and 5B are illustrated for one and one-half cycles of the 60 Hz input. FIG. 5C is a corresponding waveform of the charging current indicated by the arrow 56 shown in FIG. 2, through the fifth resistor 54 and into the capacitor 24 subsequent to the chip reaching its stable operating temperature of about 125° C. and the PCT resistor achieving its stable value in the manner set out above in connection with discussion of the operation of the circuit of FIGS. 1A and 1B. As can be seen in FIG. 5C, there are two current spikes 48, 49 for each cycle of A.C. input. These current spikes, as can be seen, are relatively short in duration.

In one practical version of the circuit illustrated in FIG. 2, it was found that the current spikes 48, 49 may reach, as illustrated in FIG. 5C, a magnitude of about 5.0 amperes or thereabouts after operating temperature has been reached, so as to provide an average charging current of approximately 0.12 ampere, the current spikes 48, 49 each being of about 0.0004 second duration.

Referring again to FIG. 2, the diode 36 provides a source of input current for the Darlington configured current amplifier composed of the transistors 39–42, as well as operating voltage for the transistor 38 of the control stage. When the A.C. voltage source 22 ($e_1$) is positive and slightly greater, for example about 2.6 volts greater than the battery potential $E_b$ of the capacitor 24 which is to be recharged, the transistor 38 does not conduct, yet current at this voltage difference, flows through the resistors 53 and 55 into the base of the transistor 39. This current is amplified by the transistors 39–42 and flows through the fifth resistor 54 into the capacitor 24 thereby starting to charge the capacitor as the leading edge of current spike 48 starts toward the 5.0 ampere level. This current can be considered to be increasing as the voltage supplied via the rectifying diode 36 becomes more positive and reaches its peak of about 5.0 amperes when the line voltage is about 10 volts greater than the voltage $E_b$ of the capacitor 24 being charged. The control transistor 38 starts to conduct at this voltage level, its emitter-collector current flowing through the resistors 53, 55 resulting in a reduction of voltage applied to the base electrode of the transistor 39 and, consequently, in a decrease in the charging current $i_c$ as illustrated by the trailing edge of the current spike 48. Increasing current is supplied, as the difference between the potential $E_b$ of the capacitor 24 and the voltage $e_1$ source 22 to the base of the transistor 38, via the voltage divider consisting of the fifth resistor 54, the first resistor 51 and the second resistor 52, as well as the third resistor 53 if present, which are connected in series, as pointed out above, between the diode 36 and one plate of the capacitor 24. Once the current into the base of the transistor 38 is sufficient, which occurs as pointed out above, when the difference between the line voltage $e_1$ and capacitor voltage $E_b$ reaches a level of about 10.0 volts, to turn this transistor on, considerable current starts to flow through the emitter-collector path. As the voltage difference increases still further, that is toward 27.6 volts, the voltage, and thus the current, supplied to the base of the transistor 39 decreases causing the current amplifier consisting of the transistors 39–42, connected in Darlington configuration to be reduced and the transistors 39–42 are quickly turned off when the difference reaches 27.6 volts. The control transistor 38 continues to conduct and the transistors 39–42 remain off as the voltage difference between the capacitor voltage $E_b$ and the line voltage $e_1$ becomes still greater. The charging current reached a peak level of about 5.0 amperes as illustrated by current spike 48 in FIG. 5C, the duration of the current spike 48 being about 0.0004 seconds. This action takes place during an initial portion of the half-wave voltage output from the rectifying diode 36. As the voltage difference between the line voltage $e_1$ and the capacitor voltage $E_b$ increases still further and then becomes less, again reaching about 27.6 volts, the transistors 39–42 are again turned on producing the leading edge of current spike 49, which spike is limited to a maximum of about 5.0 amperes, at this point the difference between the line voltage $e_1$ and capacitor voltage $E_b$ again reaches 10 volts. Later, as the half-wave voltage output from the diode 36 falls further, the current provided to the base-emitter path of the transistors 39–42 falls as well, finally reaching a point where it is insufficient to keep the transistor 38 and the transistors 39–42 in the conductive state. This condition is reached when the difference between the line voltage $e_1$ and the capacitor voltage $E_b$ again reaches about 2.6 volts. These actions take place time and time again providing, in effect, a charge current in the form of current spikes 48, 49 to the capacitor 24 and can continue until the capacitor is fully charged. As in the first embodiment, in both variant forms, the capacitor 24 may be discharging during this time, via the resistance 26 and the output terminals 28, 29 into a load, the Zener diode 27 providing a regulated voltage output.

In operation, the external feedback provided by the fifth resistor 54 as connected and the internal feedback provided by the third resistor 53 if present as connected can be considered, in effect, to vary the resistance of the control stage and cause the transistor 38 to limit current flow in the transistor 39–42 to periods when relatively low voltages are present and to, in effect, turn the transistors 39–42 off during times higher voltages are present.

Figure 3:
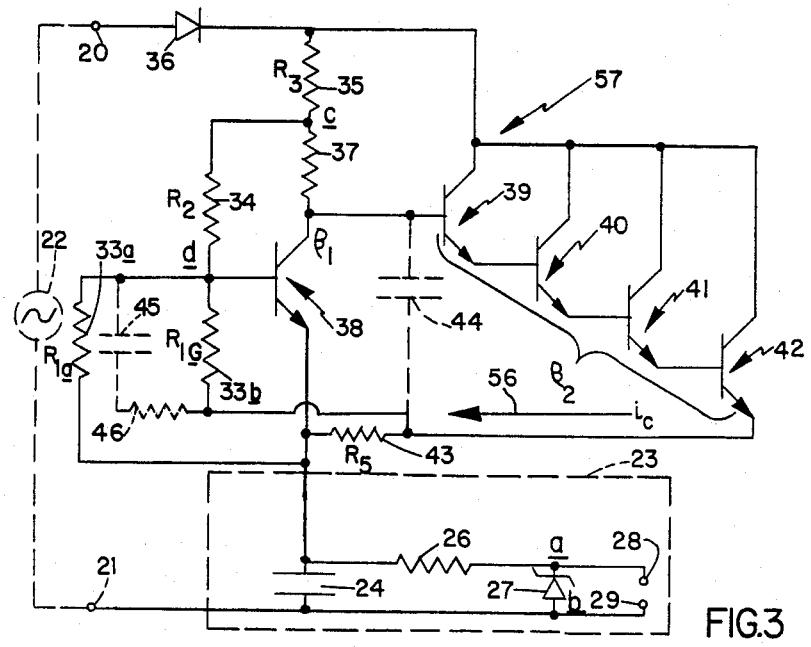
FIG. 3 is a circuit diagram of a third embodiment of a power supply incorporating features of the first and second embodiments.

As illustrated in FIG. 3, a third embodiment, a power supply constructed in accordance with the present invention includes a current regulating circuit generally designated by the numeral 57 and includes a pair of terminals 20, 21 which are shown, for purposes of illustration, connected across a conventional, 117 volt 60 Hz voltage source 22. Also shown in FIG. 3 is a smoothing circuit 23 which includes a 1000 $\mu$f storage capacitor 24 realized as an electrolytic capacitor connected between the terminal 21 and the emitter of a transistor 38. A 56 ohm resistor 26 and a Zener diode 27 are connected in series across the storage capacitor 24, output terminals 28, 29 of the power supply being connected across the Zener diode 27 between circuit points a and b. The Zener diode 27 can be realized, for example, as a 9.1 volt diode designated by the numeral ECG 5018A. The current regulating circuit designated generally by the numeral 57 is connected in series with the storage capacitor 24 across the terminals 20, 21 so that it can receive current pulses from the current regulating circuit 57.

It is to be appreciated that the circuit illustrated in FIG. 3 can be utilized to charge capacitors of considerably different sizes and voltage levels from sources of different levels and/or supply frequencies, the conventional 117 volt and 234 volt levels and 60 Hz frequency being set out by way of example only. The current regulating circuit 57 includes, a first resistive impedance defined by resistors 33*a* and 33*b* considered to be connected in parallel and hereinbelow referred to as the "first resistor" (resistance $R_1$), a second resistor 34 (resistance $R_2$ connected between circuit points c and d), a third resistor 35 (resistance $R_3$) and a rectifying diode 36 connected between one plate of the capacitor 24 and the terminal 20 of the charging circuit. As illustrated, the rectifying diode 36 has its anode connected to the terminal 20 and its cathode connected to one end of the resistor 35. It is to be understood, however, that the diode 36 shown in FIG. 3, could be replaced, as shown in FIG. 1B, by the rectifying diode 36' having its cathode connected to one plate of the capacitor 24, its anode being connected to the free end of the resistor 33*a*. A fourth resistor 37 (resistance $R_4$)is connected between the connection point of the second resistor 34 and the third resistor 35 and the collector of an NPN transistor 38, which has its emitter connected to one plate of the capacitor 24 and to one end of the resistor 33*a*. The other end of the resistor 33*a* is connected to the base of the transistor 38, as well as to one end of the second resistor 34. The transistor 38 and resistors 33*a*, 33*b*, 34, 35 and 37 constitute the control stage of the current regulating circuit 57. The collector of the transistor 38 is connected, in turn, to a current amplifier which includes a Darlington connected series of NPN junction transistors 39–42. The Darlington connected transistors are selected so as to provide a relatively high current gain, for example, a current gain ($\beta_2$) of approximately 200,000, while the control stage which includes the transistor 38 is selected to also have a current gain ($\beta_1$), for example, of about 100. The collectors of each of the transistors 39–42 are connected to the cathode of the rectifying diode 36 (or to the terminal 20 of the power supply 22 in the event the circuit is modified by replacing the diode 36 with the diode 36' as shown in FIG. 1B). The base of the first of the transistors 39–42, that is the transistor 39 is connected to the collector of the switching transistor 38. The emitter of the final one of the Darlington connected transistors 39–42, that is the transistor 42, is connected to one plate of the capacitor 24 and to the emitter of the transistor 38, via a current-limiting fifth resistor 43 ($R_5$). The current-limiting fifth resistor 45 is a positive temperature coefficient (PTC) resistance, formed by metallization from materials which are selected so that this resistor will also function as a fuse, allowing circuit failure without damage to the capacitor undergoing charging, other circuit components or a load connected across terminals 28, 29 and endangering the surroundings. The current regulating circuit 57 illustrated in FIG. 3, is provided with external feedback between the output of the current amplifier constituted by the Darlington circuit configured transistors 39–42 and the switching transistor 38 by the connection between the resistor 43 and the resistor 33*b*. Internal feedback is provided by the resistor 35 because of its coupling to the base of the transistor 38 via the resistor 34 and 33*a* connected as illustrated. For purposes of selecting values of the resistances $R_2$–$R_4$ and the resistance $R_1$ (which may be calculated as the effective resistance of resistors 33*a* and 33*b* connected in parallel, resistor 43 being very small) as well as the ratios and ranges thereof, the criteria and calculations associated with the circuit of FIG. 1A are applied, as indicated below in detail.

As in the embodiments illustrated in FIGS. 1A, 1B and 2, in order to assure the circuit will not, under some circumstances undesirably oscillate, a small capacitor 44 and/or series connection of a small capacitor 45 and a resistor 45 may be connected as shown in FIG. 3 in the same fashion as illustrated in FIGS. 1A, 1B and 2.

Figure 4:
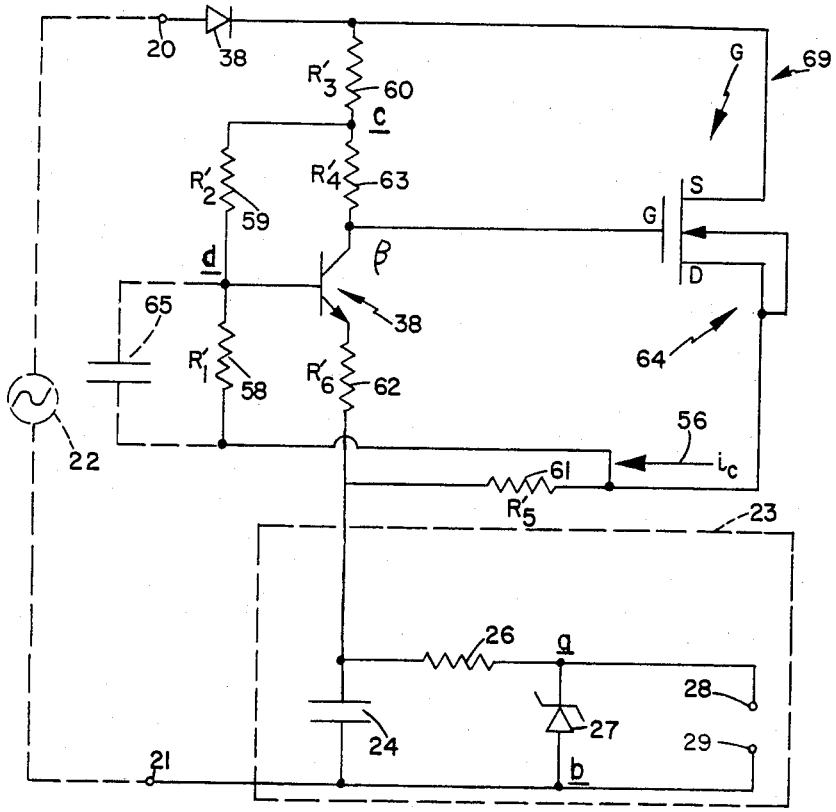
FIG. 4 is a circuit diagram of a fourth embodiment of a power supply, this embodiment including a field effect transistor.

By way of example only, typical values for circuit parameters of the regulating circuit illustrated in FIG. 4, which would be used in an exemplary integrated circuit embodiment are:

| | |
|---|---|
| $R_1$ = 8,946 ohms, | $i_a$ = .12 ampere (average), |
| $R_2$ = 120,543 ohms, | $i_p$ = 5.0 ampere (peak), |
| $R_3$ = 54,668 ohms, | $\beta_1$ = 100 (current gain, control stage), |
| $R_4$ = 13,667 ohms, | $\beta_2$ = 200,000 (current gain, |
| $R_5$ = .385 ohms, | current amplifier). |

It is to be appreciated that the individual values for the resistances $R_1$–$R_4$ can vary considerably, as a practical matter by about ±20 percent, the exact values for resistances $R_1$–$R_4$ not being nearly as important as the ratios among them. The ratios of $R_1$:$R_4$, $R_2$:$R_4$ and $R_3$:$R_4$, in a practical case, should desirably be within the range of substantially ±5 percent and preferably substantially ±1 percent. These criteria make it possible to realize the charging circuit 57 of FIG. 3 as an integrated circuit using diffusion techniques. It is conceived that the integrated circuit, in an exemplary practical realization can be contained within a small housing preferably of cylindrical shape and having a length of about 3/16 inch and a diameter of about 5/36 inch. Two concentric wire leads each of about one inch can be provided to extend from the housing. The smoothing circuit 23, except for the storage capacitor 24, may be and preferably is part of the integrated circuit.

Accordingly, expressing the above-mentioned ratios as constants $K_1$, $K_2$ and $K_3$, respectively, we have:

$K_1=0.65\pm0.03=R_1/R_4$, $K_2=8.82\pm0.44=R_2/R_4$, and $K_3=4.00\pm0.20=R_3/R_4$; or, as the preferred case is, $K_1=0.65\pm0.006$, $K_2=8.82\pm0.088$ and $K_3=4.00\pm0.04$.

The fifth resistance $R_5$ need not be in a particular ratio with respect to the other resistances and can readily be formed by metallization and be constituted by a metal contact to or between circuit points. The resistance $R_5$ is desirably a positive temperature coefficient (PTC) resistance, which increases in value as temperature increases, thus limiting current flow. The size of resistance $R_5$, relative to the sizes of resistances $R_1$–$R_4$, is very small. The resistance $R_5$ acts to stabilize the current regulating circuit which, in a practical case, operates at a temperature of about 125° C. during battery charging when the chip is provided with a suitable thermal mounting. Charging current will decrease with an increase in ambient temperature of approximately forty-five hundredths of one percent (0.45%) per degree Centigrade.

The circuit shown in FIG. 3, operates in the same fashion as those circuits illustrated in FIGS. 1A, 1B and 2 so far as the above-set-out description of the operation of these circuits are concerned, references being made to FIGS. 5A–5C; accordingly these need not be repeated at this point.

As illustrated in FIG. 4, like reference numerals designating like circuit components as those in FIGS. 1A, 1B, 2 and 3, the illustrative, fourth embodiment of a power supply includes a current regulating circuit having a pair of terminals 20, 21 which are shown, for purposes of illustration, connected across a conventional, 117 volt, 60 Hz voltage source 22. Also shown in FIG. 4 is a smoothing circuit 23 which includes a 1000 μf storage capacitor 24, which may be an electrolytic capacitor connected between the terminal 21 and the emitter of a transistor 38 via its emitter bias resistor. A 56 ohm resistor 26 and a Zener diode 27 are connected in series across the capacitor 24, output terminals 28, 29 of the power supply being connected between circuit points a and b across the Zener diode 27 which may be realized, for example, as a 9.1 volt diode designated by the numeral ECG 5018A. The current regulating circuit designated generally by the numeral 69 is connected in series with the capacitor 24 across the A.C. source 22, via the terminals 20, 21.

The current regulating circuit 69, as illustrated in FIG. 4, can be used to charge the capacitor 24 from 117 volt, 60 Hz power supplies and from 234 volt, 60 Hz power supplies. It is to be appreciated, however, that the current regulating circuit illustrated in FIG. 4 can be utilized to charge capacitors of considerably different voltage levels and itself have different levels and/or supply frequency, the above-mentioned levels and frequency being set out by way of example only. The current regulating circuit 58 includes, a first resistor 58 (resistance $R'_1$) and a second resistor 59 (resistance $R'_2$ connected between circuit points c and d), a third resistor 60 (resistance $R'_3$) which is included if internal feedback is desired, and a fifth resistor 54 (resistance $R'_5$) in series with a rectifying diode 36 connected between a terminal 20, connected to an A.C. source 22, and one end of the resistor 60 (alternatively, the rectifying diode may be connected, as illustrated by rectifying diode 36' as illustrated in FIG. 1B). A further resistor 62 (resistance $R'_6$) is connected between the emitter of the transistor 38 and one plate of the capacitor 24 or to anode of the rectifying diode 36', were the circuit of FIG. 4 modified by placing the rectifying diode as shown in FIG. 1B. As illustrated, the rectifying diode 36 has its anode connected to the terminal 20 and its cathode connected to one end of the third resistor 60. A fourth resistor 63 (resistance $R'_4$) is connected between the connection of the second resistor 59 and the third resistor 60 and the collector of the NPN transistor 38, which has its emitter connected to the capacitor 24, via the further resistor 62, and, via the fifth resistor 61, to one end of the first resistor 58, which has its other end connected to the base of the transistor 38, as well as to one end of the second resistor 59. The transistor 38 and the resistors 58–63 constitute the control stage of the current regulating circuit 57. In the event the third resistor 60 is not present, the resistance $R_3$ being zero, and the ends of the resistor 59 and the resistor 63 not connected to electrodes of the transistor 38 would be connected directly to the cathode of the diode 36 or to the terminal 20 in the event the diode is positioned as diode 36', shown in FIG. 1B. Only external feedback would be provided were the value of resistance $R'_3$ zero. The collector of the transistor 38 is connected, in turn, to the gate electrode (G) of a field-effect-transistor (FET), preferably a metal oxide, silicon field-effect-trasistor (MOSFET) 64. The MOSFET 64 is selected so as to provide a relatively high transconductance (G) of about two mhos while the transistor 38 of the control stage is selected to also have in circuit a relatively high current gain ($\beta$), for example, a gain of about 100. The source electrode (S) of the MOSFET 64 is connected to the cathode of the rectifying diode 36 (or to the terminal 20 if the diode is positioned as shown in FIG 1B). The gate of the MOSFET 64 is connected to the collector of the transistor 38. The drain electrode (D) of the MOSFET 64 is connected to the one plate of the capacitor 24 (or to the anode of the rectifying diode 36 if the diode is positioned as shown in FIG. 1B) and to the emitter of the control transistor 38, via the fifth resistor 61. The substrate of the MOSFET 64 is conductively connected to its drain electrode (D). The current regulating circuit 58 illustrated in FIG. 4 is provided with external feedback between the output of the amplifier constituted by the MOSFET 64 and the switching transistor 38 via the fifth resistor 61 which has its end not connected to a plate of the capacitor 24 (or the anode of the diode 36' were the variant feature of FIG. 1B used) connected to that end of the first resistor 58 which is not connected to the base of the transistor 38. Additional internal feedback is provided, as in the embodiment illustrated in FIG. 2, but virtue of the third resistor 60 because of its coupling to the base of the transistor 38, as illustrated.

To avoid the circuit going into oscillation, a small capacitor 65 for example, a 1200 $\rho$f capacitor, may be connected in parallel with the resistor 58.

Again, by way of example only, typical values for circuit parameters of the current regulating circuit illustrated in FIG. 4, which could be used in an integrated circuit embodiment are:

| | |
|---|---|
| $R'_1$ = 3,900 ohms, | $a_1$ = .12 ampere (average), |
| $R'_2$ = 100,000 ohms, | $i_p$ 5.0 ampere (peak), |
| $R'_3$ = 18,000 ohms, | $\beta$ = 100 (current gain, control stage), |
| $R'_4$ = 36,000 ohms, | G = 2.0 mhos (transconductance |
| $R'_5$ = .07 ohms, | of MOSFET amplifier). |
| $R'_6$ = 270 ohms, | |

As in other embodiments, in the embodiment illustrated in FIG. 4, the individual values for the resistances $R'_1$–$R'_4$ can vary considerably, as a practical matter by about ±20 percent, the exact values for resistance $R'_1$–$R'_4$ not being as important as the ratios among them. The ratios of $R'_1$:$R'_4$, $R'_2$:$R'_4$ and $R'_3$:$R'_4$, in a practical case should desirably be within the range of substantially ±5 percent and preferably substantially ±1 percent. These criteria make it possible to realize the current regulating circuit portion of the circuit of FIG. 4 as an integrated circuit using diffusion techniques, the same dimensional characteristics mentioned in conjunction with the other embodiments applying equally well to this embodiment. Accordingly, expressing the above-mentioned ratios as constants $K'_1$, $K'_2$, and $K'_3$, respectively, we have $K'_1 = 0.57 \pm 0.03 = R'_1/R'_4$, $K'_2 = 7.69 \pm 0.38 = R'_2/R'_4$, and $K'_3 = 4.00 \pm 0.20 = R'_3/R'_4$; or, as the preferred case is, $K'_1 = 0.57 \pm 0.066$, $K'_2 = 7.69 \pm 0.076$ and $K'_3 = 4.00 \pm 0.04$.

The resistance $R'_5$ need not be in a particular ratio with respect to the other resistances and can easily be formed by metallization and be constituted by a metal contact to or between circuit points. As in the case of the other embodiments, the resistance $R'_5$ is desirably a positive temperature coefficient (PTC) resistance which increases in value as the temperature increases, thus limiting the current flow and serving to stabilize the circuit which in a practical integrated circuit version may operate at a chip temperature of about 125° C. during battery charging when the chip is provided with a suitable thermal mounting. The PTC resistor 61 ($R'_5$) is preferably formed by metallization with materials which are selected so that the resistor will also function as a fuse, allowing the circuit to fail without damaging the capacitor undergoing charging, its associated circuit components and/or the load device or devices which may be connected to the output terminals 28, 29. Charging current will decrease with an increase in ambient temperature of approximately ¼ percent per degree Fahrenheit. The resistor 62, serving principally as a biasing resistor for the transistor 38 need not be in any particular ratio relationship to the resistances $R_1$–$R_4$.

The power supply circuit illustrated in FIG. 4 operates in much the same fashion as the circuits illustrated in FIG. 2, the MOSFET 64 (FIG. 4) being turned on and off by the control stage, which includes the transistor 38, as the Darlington configuration of transistors 39–42 (FIG. 2). A detailed discussion of the operation does not appear to be necessary for the waveforms shown in FIGS. 5A–5C are produced by the circuit of FIG. 4 in much the same fashion as the circuit of FIG. 2.

The circuit of FIG. 4, operates essentially as the circuit of FIG. 2 so far as the waveforms illustrated in FIGS. 5A–5C are concerned; accordingly, no detailed discussion of the sequence of operation need be repeated at this point.

In operation, the external feedback provided by the fifth resistor 61 as connected and the internal feedback provided by the third resistor 60, if present as connected can be considered, in effect, to vary the resistance of the control stage and cause its active component, transistor 38, to limit current flow in the MOSFET 64 to periods when relatively low voltages are present and to, in effect, turn the MOSFET 64 off during times higher voltages are present.

Figure 6:
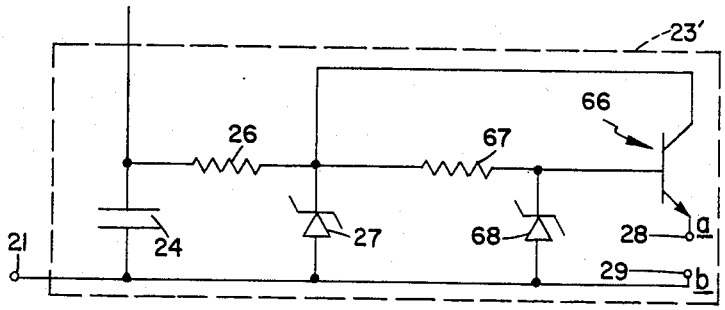
FIG. 6 is a circuit diagram of an active component smoothing circuit which may be used as a substitute for the passive smoothing circuit used in the embodiments of the power supplies illustrated in FIGS. 1A, 1B and 2–4.

Referring to FIG. 6, an active smoothing circuit 23' is illustrated. It may be substituted for the smoothing circuit 23 mentioned in connection with the embodiments and variants shown in FIGS. 1*a*, 1*b*, 3 and 4. The circuit of FIG. 6 includes, in addition to the circuit elements of smoothing circuit 23 an NPN transistor 66, which may be an ECG 198, having its collector-emitter electrode path connected in series with the Zener diode 27 which, in this case, may be a 12 volt diode available under the designation ECG 5127A, a resistive conductive connection extending between the cathodes of the Zener diode 27 and the cathode of a Zener diode 68 which, in this case, may be a 9.1 volt diode available under the designation ECG 5018A, this connection including a 330 ohm resistor 67. The resistor 26 may be realized as a 33 ohm resistor and the storage capacitor 24 as a 1000 $\mu f$ capacitor. The collector of the transistor 66 is conductively connected to a circuit point between the resistor 67 and the Zener diode 27, this point being conductively connected to the collector of the transistor 66. The smoothing circuit 23' illustrated in FIG. 6, as well as the smoothing circuit 23 shown in other figures, provides a maximum output current of about 0.12 ampere; its output ripple voltage, in both cases, in the output range is less than one millivolt peak-to-peak.

Figure 7:
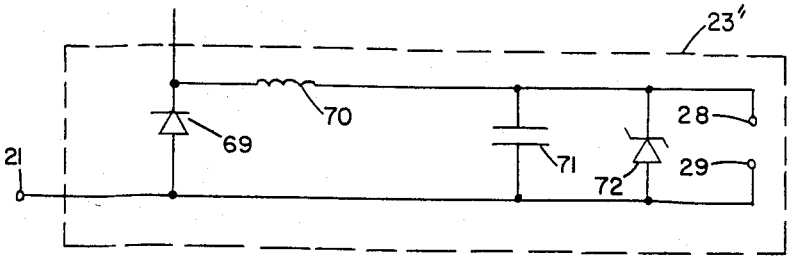
FIG. 7 is a circuit diagram of a passive smoothing circuit which may be substituted for the smoothing circuit used in the embodiments of the power supply illustrated in FIGS. 1A, 1B and 2–4.

As illustrated in FIG. 7, a passive smoothing circuit 23'', which may be substituted for the smoothing circuits 23 and 23', includes a flyback diode 69 having its anode connected to one terminal 21 of the A.C. source, its cathode being connected to one end of an inductor 70. The other end of the inductor 70 is connected to one plate of a storage capacitor 71 which has its other plate connected to the anode of the flyback diode 69 and the terminal 21. A Zener diode 72 is connected across the capacitor 71, the Zener diode being poled in the same fashion as the flyback diode 69. A pair of output terminals 28,29 are connected between circuit points a and b across the capacitor 71. The components of the circuit illustrated in FIG. 7, except for the capacitor 71 and the inductor 70 may be and preferably are formed on a chip as an integrated circuit. In many instances, it may be desirable from commercial considerations to not form any of the components of the circuit 23'' as a part of a chip, electing to use other conventional techniques to form the circuit 23'', such as using circuit boards and the like.

Figure 8:
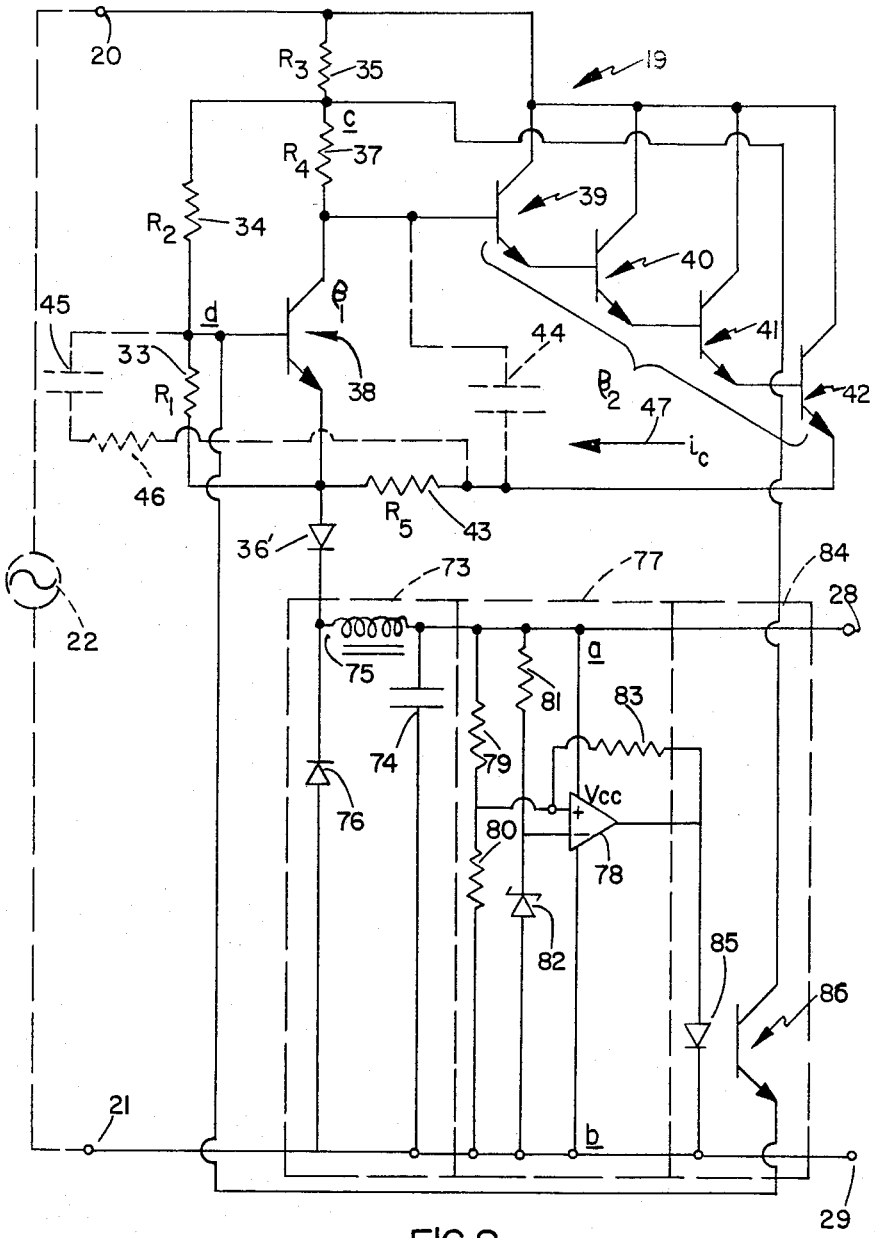
FIG. 8 is a circuit diagram of an exemplary embodiment of a power supply according to the present invention corresponding to the circuit of FIG. 1B modified by incorporating therewith a voltage output control circuit in accordance with the present invention.

As illustrated in FIG. 8, the illustrative embodiment of a power supply constructed in accordance with the present invention and similar to the embodiment illustrated in FIG. 1B includes a current regulating circuit generally designated by the numeral 19 and includes a pair of terminals 20, 21 which, as shown for purposes of illustration, is connected across a conventional 117 volt, 60 Hz voltage source 22. Also shown in FIG. 8 is a smoothing circuit 73 which includes a 1000 $\mu f$ storage capacitor 74 realized as an electrolytic capacitor having an electrode connected to the terminal 21. An iron core inductor 75 and a flyback diode 76 are connected in series with one another across the storage capacitor 74, output terminals 28, 29 of the power supply being connected between circuit points a and b across the storage capacitor 74. The flyback diode 76 has its anode connected to the terminal 21 of the A.C. source, its cathode being connected to one end of the inductor 75 and to the cathode of a rectifying diode 36'. The current regulating circuit, which includes the rectifying diode 36' and designated generally by the numeral 19, is connected between the smoothing circuit 73 and the terminal 20, placing the storage capacitor 74, and the inductor 75 in circuit so that current pulses from the current regulating circuit 19, smoothed by the inductor 75, charge the capacitor 74.

The current regulating circuit 19 illustrated in FIG. 8 includes, a first resistor 33 (resistance $R_1$), a second resistor 34 (resistance $R_2$ connected across circuit points c and d), a third resistor 35 (resistance $R_3$) and the rectifying diode 36' connected, via the inductor 75, between that plate of the capacitor 74 which is not connected to the terminal 21 and the terminal 20 of the charging circuit. The rectifying diode 36' has its cathode connected to that end of the inductor 75 not connected to the capacitor 74 and to the cathode of the flyback diode 76, its anode being connected to the free end of the resistor 33. A fourth resistor 37 (resistance $R_4$) is connected between the connection point of the second resistance 34 and the third resistor 35 and the collector of an NPN transistor 38 which has its emitter connected to one end of the first resistor 33. The other end of the first resistor 33 is connected to the base of the transistor 38, as well as to one end of the second resistor 34. The transistor 38 and resistors 33, 34, 35 and 37 constitute the control stage of the current regulating circuit 19. The collector of the transistor 38 is connected, in turn, to a current amplifier which includes a Darlington connected series of NPN junction transistors 39–42. The Darlington connected transistors are selected so as to provide a relatively high current gain, for example, a current gain ($\beta_2$) of approximately 200,000, while the control stage which includes the transistor 38 is selected to have a current gain ($\beta_1$), for example, of about 100. The collectors of each of the transistors 39–42 are connected to the terminal 20 of the power supply 22. The base of the first of the transistors 39–42, that is the transistor 39 is connected to the collector of the switching transistor 38. The emitter of the final one of the Darlington connected transistors 39–42, that is the transistor 42, is connected to the anode of the rectifying diode 36' and to the emitter of the transistor 38, via a current-limiting fifth resistor 43 ($R_5$). The current-limiting fifth resistor 43 is a positive temperature coefficient (PTC) resistance, formed by metallization from materials which are selected so that this resistor will also function as a fuse, allowing circuit failure without change to the battery undergoing recharging and endangering the surroundings. The current regulating circuit 19 illustrated in FIG. 8 is not provided with external feedback between the output of the current amplifier constituted by the Darlington circuit configured transistors 39–42 and the switching transistor 38; however, internal feedback is provided by the third resistance 35 because of its coupling to the base of the transistor 38 via the second resistance 34 and the first resistance 33 connected as illustrated.

In order to avoid the possibility of the circuit 19 oscillating, a small capacitance 44 may be connected between the collector of the transistor 38 and the emitter of transistor 42 and/or a series connection of a small capacitor 45 and a resistor 46 is connected between the base of the transistor 38 and the emitter of the transistor 42.

By way of example only, typical values for circuit parameters of the current regulating circuit 19 illustrated in FIG. 8 correspond to those of FIGS. 1A and 1B having corresponding reference numerals.

It is to be appreciated that the individual values for the resistance $R_1$–$R_4$ of the circuit of FIG. 8 can vary considerably, as a practical matter, like the circuits of FIGS. 1A, 1B, by about ±20 percent, the exact values for resistances $R_1$–$R_4$ not being nearly as important as the ratios among them. The ratios of $R_1$:$R_4$, $R_2$:$R_4$ and $R_3$:$R_4$, in a practical case, should desirably be within the range of substantially ±5 percent and preferably substantially ±1 percent.

A D.C. output voltage sensing circuit 77 is provided which is responsive to the D.C. output voltage which appears across the ouput terminals 28, 29; that is, the voltage between the circuit points a and b. The sensing circuit as illustrated, is realized as a Schmitt trigger circuit. The Schmitt trigger includes an operational amplifier 78 which has its noninverting input terminal connected to a point on a voltage divider, shown for purposes of illustration as a circuit point between a resistor 79 and a resistor 80, connected in series across the capacitor 74 and thus between the output terminals 28, 29. The inverting input terminal of the operational amplifier 78 is connected to a circuit point between a resistor 81 and a Zener diode 82 connected in series across the capacitor 74 and thus the output terminals 28, 29. The output terminal of the operational amplifier 78 is connected to its noninverting input terminal via a resistor 83. Operating bias $V_{cc}$ for the operational amplifier 78 is provided via a connection to the D.C. output terminal 28, another connection being provided to the output terminal 29 which is reference ground.

The output terminal of the operational amplifier 78, which is the output for the Schmitt trigger is connected to reference ground via a light emitting diode (LED) 85, which is part of an optical coupling circuit 84 and which is positioned physically opposite the base of a NPN phototransistor 86 having its collector connected to the circuit point c between the resistor 35 and the resistor 37. The emitter of the phototransistor 86 is connected to the circuit point d between the resistor 34 and the resistor 33. Whenever the phototransistor 86 conducts, the resistor 34 is virtually shorted out, causing the control transistor 38 to start to conduct at relatively low level collector voltages, with the result that the Darlington configured transistors 39–42 are virtually turned off and are held off until the phototransistor 86 is turned off, this turning off occuring whenever the Schmitt trigger returns to its initial state upon the voltage across the capacitor 74 dropping below a second given level which is slightly less than the voltage level at which the Schmitt trigger changes from its initial off state to its on state. This prevents the capacitor 74 from becoming charged to too high a voltage level and maintains the D.C. output voltage between the two predetermined values.

In operation, the circuit arrangement shown in FIG. 8 is placed in operation by connecting the current regulating circuit 19 to the voltage source 22 which is shown as connected between the input terminals 20, 21 of the current regulating circuit 19. The capacitor 74 to be charged is connected between the terminal 21 and the current regulating circuit 19, its voltage being illustrated in FIGS. 5A and 5B as $E_b$. FIG. 5A shows the voltage waveform $e_1$ as a function of time of the input source voltage 22 for a conventional 117 volt (rms), 60 Hz household outlet supply. FIG. 5B is a waveform $e_2$ of the rectified voltage at the output of the rectifier diode 36'. The voltage waveforms as shown in FIGS. 5A and 5B are illustrated for one and one-half cycles of the 60 Hz input. FIG. 5C is a corresponding waveform of the charging current $i_c$, during operation after the stable operating temperature of about 125° C. has been reached, as indicated by the arrow 47 shown in FIG. 8 through the fifth resistor 43 and, via the inductor 75, into the capacitor 74. As can be seen in FIG. 5C, there are two current spikes 48, 49 for each cycle of A.C. input, the peak charging current $I_p$ being about 5.0 amperes. These current spikes 48, 49, as can be seen, are relatively short in duration, for example about 0.0004 seconds, resulting in an average charging current $1_a$ of about 0.12 ampere.

Referring again to FIG. 8, the diode 36' provides a source of input current for the Darlington configured current amplifier defined by the transistors 39–42, the operating voltage for the switching transistor 38 of the control stage, as well as operating potential for the phototransistor 85. Initially, relatively high current spikes are produced, causing the PTC resistor 43 to increase in value, because of heating thereof; resulting in the current spikes having lesser magnitudes as they approach the 5.0 ampere level and the chip achieves its stable operating temperature of about 125° C. Thereafter, when the A.C. voltage $e_1$ of the source 22 is positive and slightly greater, for example, less than 2.6 volts with respect to the voltage $E_b$ of the capacitor 74 which is to be charged, the transistors 38 and 39–42 do not conduct. When the voltage difference reaches about 2.6 volts, capacitor charging current starts to flow through the transistors 39–42, illustrated as the leading edge of the current spike 48 in FIG. 5C. The current into the base of the transistor 39 in effect is amplified by the transistors 39–42 and initially flows at a relatively low level, through the fifth resistor 43 into the capacitor 74 via the inductor 75 thereby starting to charge the capacitor 74 as the leading edge of the current spike 48 starts toward the 5.0 ampere level. This current, illustrated as current spike 48, can be considered to be increasing as the voltage supplied to the collectors of the transistors becomes more positive and reaches its peak of about 5.0 amperes when the line voltage $e_1$ is about 10 volts greater than the capacitor voltage $E_b$. Increasing current is supplied not only to the Darlington connected transistors 39–42, but also to the base of the transistor 38, via the voltage divider consisting of the first resistor 33, the second resistor 34 and the third resistor 35, which are connected in series, as pointed out above, between the diode 36' and the terminal 20 of the source 22. Once the current into the base of the transistor 38 is sufficient, when the line voltage $e_1$ reaches the level of about 10.0 volts greater than the voltage $E_b$ of the capacitor 74, to turn this transistor on, considerable current starts to flow through the emitter-collector path thereof, reducing the voltage, and thus the current, supplied to the base of the transistor 39 causing the current amplifier, consisting of the transistors 39–42 connected in Darlington configuration, to exhibit reduced current flow, as illustrated by the trailing edge of the current spike 48 in FIG. 5C and quickly turn off the resulting current spike 48 which has a duration of about 0.0004 seconds. The transistors 39–42 are turned off when the line voltage reaches a difference of about 27.6 volts with respect to storage capacitor voltage $E_b$. During this time period, because of the internal feedback provided as a result of the lowering of the voltage, at the point of connection between the second resistor 34 and the third resistor 35, the effective resistance of the transistor 38 increases. The transistors 39–42 are again turned on when the difference between the line voltage again reaches, as it falls, about 27.6 volts with respect to the storage capacitor voltage $E_b$ while the transistor 38 is conducting, with the result of the leading edge of the current spike 49 of FIG. 5C is produced, this current spike reaching a peak of about 5.0 amperes when the voltage difference between the voltage $e_1$ and the storage capacitor voltage $E_b$ again reaches about 10 volts. The transistors 39–42 remain conducting until the difference between the input voltage $e_1$ and the storage capacitor voltage $E_b$ again reaches about 2.6 volts. Thus current spike 49 of about 5.0 amperes and 0.0004 second duration is produced. These actions take place every other half cycle of the input voltage $e_1$ with the result that the two current spikes 48, 49 are produced, one at the starting portion and the other at the ending portion of each of these half cycles. Thus, a charging current spike is produced for a short period of time, for example, of about 0.0004 seconds as indicated about during an initial portion of the rectified half-wave voltage output $e_2$ from the rectifying diode 36' and another current spike during its terminal portion, both spikes having a duration of about 0.0004 seconds as indicated above. These actions take place time and time again providing, in effect, a charge in the form of current spikes to the capacitor 74 via the inductor 75 which continue until the capacitor 74 is fully charged to a first given level. During this time, the capacitor 74 may be discharging, via the output terminals 28, 29. Whenever the voltage across the capacitor 74 reaches the first given level, the operational amplifier 78 changes from its initial low output state to its high output state, causing the LED 85 to be turned on. This causes the phototransistor 86 to be turned on, placing a low value shunt, virtually a short circuit, across the resistor 34, thus applying a higher voltage to its base. The transistor 38 accordingly is turned on, high current flows in the resistors 35 and 37 and the Darlington configured transistors 39–42 are consequently turned off because the bias voltage to the base of the transistor 39 falls. The high current spikes 48, 49 do not tend to charge the capacitor 74. Whenever the voltage across the capacitor 74 later falls to a second given level because of discharge into a load, which second level is slightly less than the first given level, the operational amplifier 78 returns to its initial low state, the LED diode 85 is turned off and the phototransistor 86 returns to its nonconductive state. The current regulating circuit 19 consequently again starts supplying current pulses to the smoothing circuit 73 and the capacitor 74 tends to charge towards the first given level again, via the conductor 75.

As can be seen from the foregoing, the D.C. output voltage supplied to a load from the terminals 28, 29 is maintained between the first and second given levels because of the action of the Schmitt trigger circuit which includes the operational amplifier 78.

It is to be appreciated that the voltage sensing circuit 77 and the optical coupler 84 can be used, instead of the Zener diode 27 in any of the power supplies illustrated in FIGS. 1A, 1B and 2–4 or any of these circuits modified to have had smoothing circuits such as those shown in FIGS. 6 and 7. Other smoothing filters could be substituted as well. The sensing circuit 77 and the optical coupler 84, in each of these cases, would replace Zener diode 27 and be connected to the circuit points a, b, c and d, these points being shown in FIGS. 1A, 1B and 2–4, if one wished to provide voltage regulation of the D.C. output.

It is to be understood that the foregoing description and accompanying figures of drawing have been set out by way of example, not by way of limitation. Numerous other embodiments and variants of the power supply circuit are possible, without departing from the spirit and scope of the present invention, its scope being defined by the appended claims.

What is claimed is:

1. A power supply comprising rectifying circuit means for supplying unfiltered rectified voltage, circuit means for producing current pulses and smoothing circuit means for providing D.C. voltage output connected in series, and D.C. voltage output sensing means coupled to said smoothing circuit and responsive to the D.C. voltage output for producing a control signal whenever the D.C. voltage output reaches or exceeds at least a given level, said circuit means for producing current pulses being responsive to the control signal and to instant amplitude of the unfiltered rectified voltage to block current pulses to said smoothing circuit whenever the control signal is present and to pass current pulses to said smoothing circuit means in absence of the control signal during periods when the rectified voltage is between a first level defined at least in part by voltage across said smoothing circuit means and a higher second level and to block current pulses to said smoothing circuit means during periods when the rectified voltage is greater than the second level.

2. A power supply according to claim 1, wherein said D.C. voltage output sensing means initially produces the control signal whenever the D.C. voltage output reaches or exceeds at least the given level and continues to produce the control signal so long as the D.C. voltage output does not reach a second given level which is less than the first given level.

3. A direct current power supply according to claim 2, wherein said D.C. voltage output sensing means comprises a Schmitt trigger circuit.

4. A direct current power supply according to claim 3, including optical coupling means in circuit between said Schmitt trigger circuit and said circuit means for producing current pulses.

5. A direct current power supply according to claim 2, including optical coupling means in circuit between said D.C. output voltage sensing means and said circuit means for producing current pulses.

6. A direct current power supply according to claim 1, including optical coupling means in circuit between said D.C. output voltage sensing means and said circuit means for producing current pulses.

7. A direct current power supply according to claim 1, wherein said circuit for producing current pulses comprises a control stage and controlled charging current carrying means coupled to said smoothing circuit means for supplying current thereto, said control stage being responsive to a control signal corresponding to the control signal produced by said D.C. output voltage sensing means.

8. A power supply according to claim 7, wherein said control stage comprises a first transistor and said controlled charging current carrying means comprises at least one Darlington configured plurality of transistors having control signal input means coupled to said control stage and responsive to its output.

9. A power supply according to claim 7, wherein said control stage comprises a first transistor and said controlled charging current carrying means comprises at least one field effect transistor having a control signal input means coupled to said control stage and responsive to its output.

10. A power supply comprising rectifying circuit means for suplying rectified voltage, circuit means for producing current pulses and smoothing circuit means for providing D.C. voltage output connectdd in series, and D.C. voltage output sensing means coupled to said smoothing circuit and responsive to the D.C. voltage output for producing a control signal whenever the D.C. voltage output reaches or exceeds at least a given level, said circuit means for producing current pulses being responsive to the control signal to block current pulses to said smoothing circuit whenever the control signal is present and to pass current pulses to said smoothing circuit means in absence of the control signal during predetermined periods, and wherein said D.C. voltage output sensing means initially produces the control signal whenever the D.C. voltage output reaches or exceeds at least the given level and continues to produce the control signal so long as the D.C. voltage output does not reach a second given level which is less than the first given level.

11. A direct current power supply according to claim 10, wherein said D.C. voltage output sensing means comprises a Schmitt trigger circuit.

12. A direct current power supply according to claim 11, including optical coupling means in circuit between said Schmitt trigger circuit and said circuit means for producing current pulses.

13. A direct current power supply according to claim 10, including optical coupling means in circuit between said D.C. output voltage sensing means and said circuit means for producing current pulses.

14. A direct current power supply according to claim 10, including optical coupling means in circuit between said D.C. output voltage sensing means and said circuit means for producing current pulses.

15. A direct current power supply according to claim 10, wherein said circuit for producing current pulses comprises a control stage and controlled charging current carrying means coupled to said smoothing circuit means for supplying current thereto, said control stage being responsive to a control signal corresponding to the control signal produced by said D.C. output voltage sensing means.

16. A power supply according to claim 15, wherein said control stage comprises a first transistor and said controlled charging current carrying means comprises at least one Darlington configured plurality of transistors having control signal input means coupled to said control stage and responsive to its output.

17. A power supply according to claim 15, charging current carrying means comprises at least one field effect transistor having a control signal input means coupled to said control stage and responsive to its output.

18. A power supply comprising rectifying circuit means for supplying unfiltered rectified voltage, current regulating circuit means for producing current pulses and smoothing circuit means for providing D.C. voltage output connected in series, and D.C. voltage output sensing means coupled to said smoothing circuit and responsive to the D.C. voltage output for producing a control signal whenever the D.C. voltage output reaches or exceeds at least a given level, said circuit means for producing current pulses being responsive to the control signal and to instant amplitude of the unfiltered rectified voltage to block current pulses to said smoothing circuit whenever the control signal is present and to pass current pulses to said smoothing circuit means in absence of the control signal during periods when the rectified voltage is between a first level defined at least in part by voltage across said smoothing circuit means and higher second level and to block current pulses to said smoothing circuit means at least during periods when the rectified voltage is greater than the second level.

19. A power supply according to claim 18, wherein said D.C. voltage output sensing means initially produces the control signal whenever the D.C. voltage output reaches or exceeds at least the given level and continues to produce the control signal so long as the D.C. voltage output does not reach a second given level which is less than the first given level.

20. A direct current power supply according to claim 19, wherein said D.C. voltage output sensing means comprises a Schmitt trigger circuit.

21. A direct current power supply according to claim 20, including optical coupling means in circuit between said Schmitt trigger circuit and said current regulating circuit means for producing current pulses.

22. A direct current power supply according to claim 19, including optical coupling means in circuit between said D.C. output voltage sensing means and said current regulating circuit means for producing current pulses.

23. A direct current power supply according to claim 18, including optical coupling means in circuit between said D.C. output voltage sensing means and said current regulating circuit means for producing current pulses.

24. A direct current power supply according to claim 18, wherein said current regulating circuit for producing current pulses comprises a control stage and controlled charging current carrying means coupled to said smoothing circuit means for supplying current thereto, said control stage being responsive to a control signal corresponding to the control signal produced by said D.C. output voltage sensing means.

25. A power supply according to claim 24, wherein said control stage comprises a first transistor and said controlled charging current carrying means comprises at last one Darlington configured plurality of transistors having control signal input means coupled to said control stage and responsive to its output.

26. A power supply according ot claim 24, wherein said control stage comprises a first transistor and said controlled charging current carrying means comprises at least one field effect transistor having a control signal input means coupled to said control stage and responsive to its output.

* * * * *